US005353861A

United States Patent [19]

Roder et al.

[11] Patent Number: 5,353,861

[45] Date of Patent: Oct. 11, 1994

[54] ROLL CASTING PROCESS

[75] Inventors: Rudolf Roder, Thun; Bruno Frischknecht, Gwatt/Thun, both of Switzerland

[73] Assignee: Lauener Engineering AG, Gwatt/Thun, Switzerland

[21] Appl. No.: 865,492

[22] Filed: Apr. 9, 1992

[30] Foreign Application Priority Data

Apr. 10, 1991 [CH] Switzerland ..... 01069/91

[51] Int. Cl.[5] ..... B22D 11/06; B22D 11/07; B22D 11/20

[52] U.S. Cl. ..... 164/454; 164/480; 164/452

[58] Field of Search ..... 164/454, 413, 154, 451, 164/428, 452, 480

[56] References Cited

U.S. PATENT DOCUMENTS

| | | | |
|---|---|---|---|
| 4,497,360 | 2/1985 | Bercovici | 164/454 |
| 4,678,023 | 7/1987 | Knapp et al. | 164/480 |
| 4,727,927 | 3/1988 | Popik | 164/428 |
| 4,883,113 | 11/1989 | Matsui et al. | 164/480 |
| 4,883,113 | 11/1989 | Matsui et al. | 164/480 |
| 4,892,133 | 1/1989 | Solignac | 164/480 |
| 4,934,444 | 6/1990 | Frischknecht et al. | 164/480 |
| 4,979,556 | 12/1990 | Braun et al. | 164/428 |

FOREIGN PATENT DOCUMENTS

| | | | |
|---|---|---|---|
| 0215258 | 12/1983 | Japan | 164/452 |

*Primary Examiner*—P. Austin Bradley
*Assistant Examiner*—Erik R. Puknys
*Attorney, Agent, or Firm*—Bachman & LaPointe

[57] ABSTRACT

The process relates to the early detection and prevention of sticking when roll casting metals, especially aluminium and aluminium alloys. The strip movements in the region between the roll nip (W) and the first deflector roller (46) in the direction perpendicular to the strip surface (42, 44) are measured continuously or almost continuously and process parameters are altered in a programme-controlled manner when vibrations appear. When this microsticking is detected, process parameters can be altered before damage is caused by sticking.

16 Claims, 2 Drawing Sheets

ROLL CASTING PROCESS

The invention relates to a process for the early detection and prevention of sticking when roll casting metals.

In roll casting of metals, the casting mould is essentially formed by the casting nip between the two rolls and by lateral sealing walls. The operating time of the rolls on the hardening metal is relatively short, and a large quantity of heat must be dissipated over a short distance, especially solidification heat, frictional heat and/or deformation heat. To this end, the rolls are cooled by special devices and/or methods, e.g. by external spraying and/or internal cooling.

The process for continuous strip casting between two rolls of a roll caster is used on a broad basis in the metal industry, especially for aluminium, aluminium alloys, iron, steel, copper or brass. The hot reduction of continuous-cast and cut-to length slabs can be eliminated with this process, resulting in a considerable reduction in capital investment and operating costs.

When strip casting with a roll caster, so-called sticking occurs relatively frequently. The cast strip sticks briefly either to one of the rolls or to the two rolls alternately. Simultaneous sticking to both rolls is also possible in principle, but can be disregarded as a result of the fact that it occurs extremely rarely.

Complete sticking leads to permanent surface defects in the corresponding strip section. In view of its quality, the corresponding strip section having undesired marks usually can then no longer be used for its original intended application and is scrapped.

Several processes are known to eliminate any sticking that occurs in roll casters, but the aforementioned defective strip sections cannot be prevented.

During sticking, the adhesive force on a roll surface deflects the cast strip a little from its straight course to one side or the other. This manifests itself by an audible crackling and/or by visible strip vibrations. The supervising staff in a roll caster are therefore alerted to sticking by their senses and can begin to remove it by varying appropriate process parameters.

With the development of automated roll casting processes, measuring devices have been provided which detect variations in process parameters in the plant and allow for appropriate steps to be introduced. In this manner, devices for measuring, e.g. rolling force, elongation or roll torque, mounted in the run-in section are used.

It has also been recognised that it is necessary to detect sticking at an early stage, i.e. before this has become so great that marks impairing the quality are produced on the cast strip. However, it has not been possible to detect impending sticking in its early stages, this being referred to as microsticking, and thus to introduce suitable measures in good time, with measuring devices on a roll caster.

Therefore, the object of this invention is to provide a process of the type specified at the outset by means of which, by virtue of the detection and elimination of impending sticking, damaging marks on a cast strip can be prevented.

This problem is solved according to the invention in that the strip movements in the region between the roll nip and the first deflector roller in the direction perpendicular to the strip surface are measured continuously or almost continuously and process parameters are altered in a programme-controlled manner when vibrations appear. Particular embodiments and further developments of the invention form the subject of dependent claims.

Therefore, a continuously operating measuring device acting on the strip surfaces of the cast metal strip is used according to the invention. On the other hand, no parameters of the plant are measured.

The expression almost continuous measurement refers to the fact that the measurements are repeated continuously over very small intervals of time. These measuring intervals are of the order of 100 milliseconds or less.

By virtue of the continuously or almost continuously operating measuring devices, sticking can be detected before it has reached a damaging extent and the necessary measures can be introduced. This is of inestimable importance, as defective points in a cast strip, leading to great machinations and high costs, can be prevented.

The strip movements can be measured anywhere between the roll nip and a deflector roller, the first of these if several are provided. According to the geometry of a roll caster, the area for the arrangement of measuring devices extends over a distance of 1–3 m. In practice, however, the measuring devices are preferably arranged between the roll nip and half the distance from the roll nip to the first deflector roller, especially as close as possible to the roll nip.

The measuring devices must be mounted on a fixed, immovable support, so that all of the strip movements in the direction perpendicular to a strip surface can be precisely detected. The strip movements can be detected, e.g. by the following means known per se:

Mechanical tracers. Tracing rolls are particularly important, although contact slippers and the like can also be used, although these can leave scratch marks.

Contactless mechanical/pneumatic tracers. Air cushion sensors are at a distance of approximately 0.2 mm from the strip and damage to the strip is therefore impossible. E.g. a sensor having an integrated strain transducer by the British company Broner is particularly suitable.

Electrical contactless strain transducers. These operate on an inductive, capacitive or eddy current basis. They allow for precise measurements even at relatively large distances from the object, this allowing the probes to be mounted on suitable supports and casing components.

Optical path measuring systems. In cases where there is little space and relatively large distances are required, laser sensors are particularly important. Furthermore, e.g. infrared sensors can be used.

Ultrasonic measuring devices.

The measuring devices can act upon one or other of the strip surfaces, but also on both simultaneously. If several measuring devices are provided, they are distributed over the width of the strip.

The measuring devices can be prevented from responding to vibrations not caused by sticking in that the programme-controlled alteration of process parameters does not begin until after a certain idle period, e.g. after 0.5–2 seconds, especially after approximately 1 second.

Furthermore, the measuring devices are advantageously designed in such a manner that a response threshold can be set, corresponding to the process parameters and the metal to be processed.

According to a first variant, when vibrations appear in the cast strip, triggered by the process electronics, a parting agent is sprayed on to the surface of at least one casting roll. If a parting agent is already applied during the normal roll casting process, the concentration and thus the layer thickness applied can be increased when vibrations appear. A dressing, preferably a graphite suspension, is preferably applied in the manner known per se with the aid of spray nozzles.

According to a second variant, when vibrations appear, the solidus point of the metal hardening between the rolls is displaced in the direction of the emergent strip.

The position of the solidus point can be influenced by numerous parameters, although in this process these alterations must take effect rapidly, in the course of at most one revolution of the roll, as otherwise they would be too late. The essential parameter is the casting speed. If this is reduced, the solidus point is displaced immediately in the desired direction.

Further measures for the displacement of the solidus point in the same direction, only mentioned in note form, are: reducing the metal temperature, raising the metal level, reducing the roll nip, greater distance from the nozzle outlet opening, increasing the supply of coolant.

To summarise, it can be stated once again that by virtue of the process according to the invention impending sticking can be detected at such an early stage by detecting vibrations on the cast strip that the necessary steps for altering process parameters can be introduced in a programme-controlled manner before the actual sticking causing damage to the cast strip can occur. It is therefore a process for detecting microsticking.

The invention will now be described in more detail by way of embodiments forming the subject of dependent claims and illustrated in the accompanying diagrammatic drawings, in which:

Figure 1:
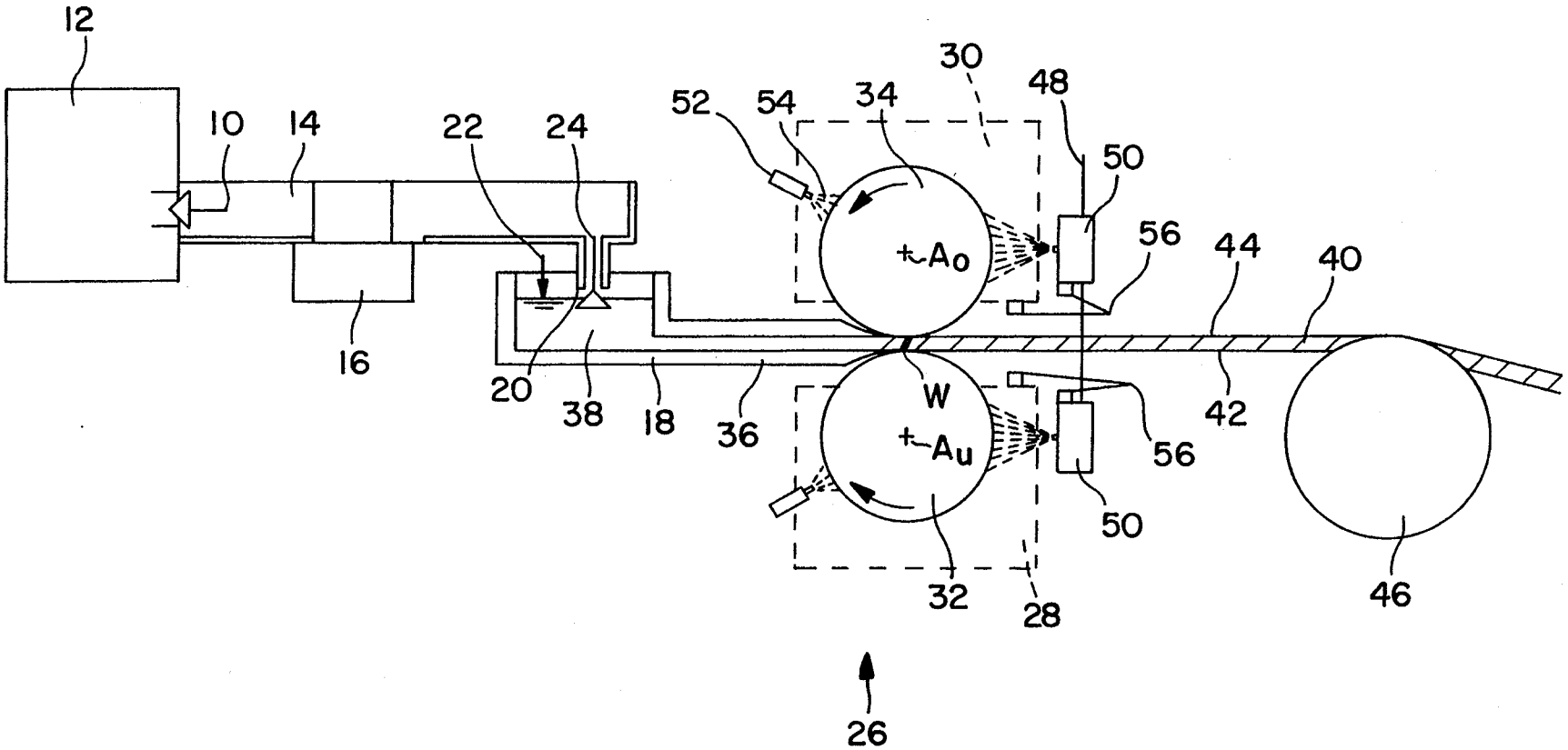
FIG. 1 is a general view of a roll casting plant having a roll caster.

The plant for the strip casting of aluminium having a roll caster shown in diagrammatic form in FIG. 1 shows the essential parts of the plant and the metal strip produced. The holding furnace 12 provided with a sealing member 10 empties the liquid aluminium into a channel 14 which includes a filter system 16. The channel 14 has a lip 20 over a melt distribution trough 18, said lip having a sealing member 24 controlled by a level measuring device 22.

The roll caster 26 without a casing includes a preloaded roll housing, not shown for the sake of clarity, having roll casings 28, 30 indicated by dotted lines, in which lower and upper casting rolls 32, 34 are housed. The axes $A_u$ and $A_o$ thereof lie vertically on top of one another. The two casting rolls 32, 34 define a roll nip W on the plane E (FIG. 2) through the two axes.

A component of the pouring nozzle 36 forming the melt distribution trough 18 extends as far as the region between the casting rolls 32, 34 and leads the liquid aluminium 38 in the direction of the roll nip W.

The liquid aluminium hardens to form a cast strip 40 having lower and upper surfaces 42, 44 by means of heat given off at the casting rolls 32, 34. The thickness of the cast strip 40 corresponds exactly to the roll nip W.

The cast strip 40 is bent downwards at a deflector roller 46, e.g. for the purposes of reeling.

The casting rolls 32, 34 of the roll caster 26 are cooled externally. Spray nozzles 50 are supplied via water pipes 48. The cooling corresponds, e.g. to EP 0 313 516 A1.

Further spray nozzles 52 are intended to apply a graphite dressing 54 to the casting rolls 32, 34, continuously or only in the case of impending sticking. By virtue of the vicinity to the roll nip W in the direction of rotation, the dressing 54 works rapidly and effectively.

Sensors 56 known per se for carrying out the process according to the invention are arranged on the cooling hood of the external cooling system, illustrated by the spray nozzles 50, and on the roll casings 28, 30, also referred to as a retaining frame. These fixed sensors 56 measure strip movements in the direction perpendicular to the surfaces 42, 44 of the cast strip 40. Of course, in practice, the sensors 56 are arranged in only one place and are in operation.

Other components of the roll casting plant which are not relevant to the invention have been omitted for the sake of simplicity and clarity.

Figure 2:
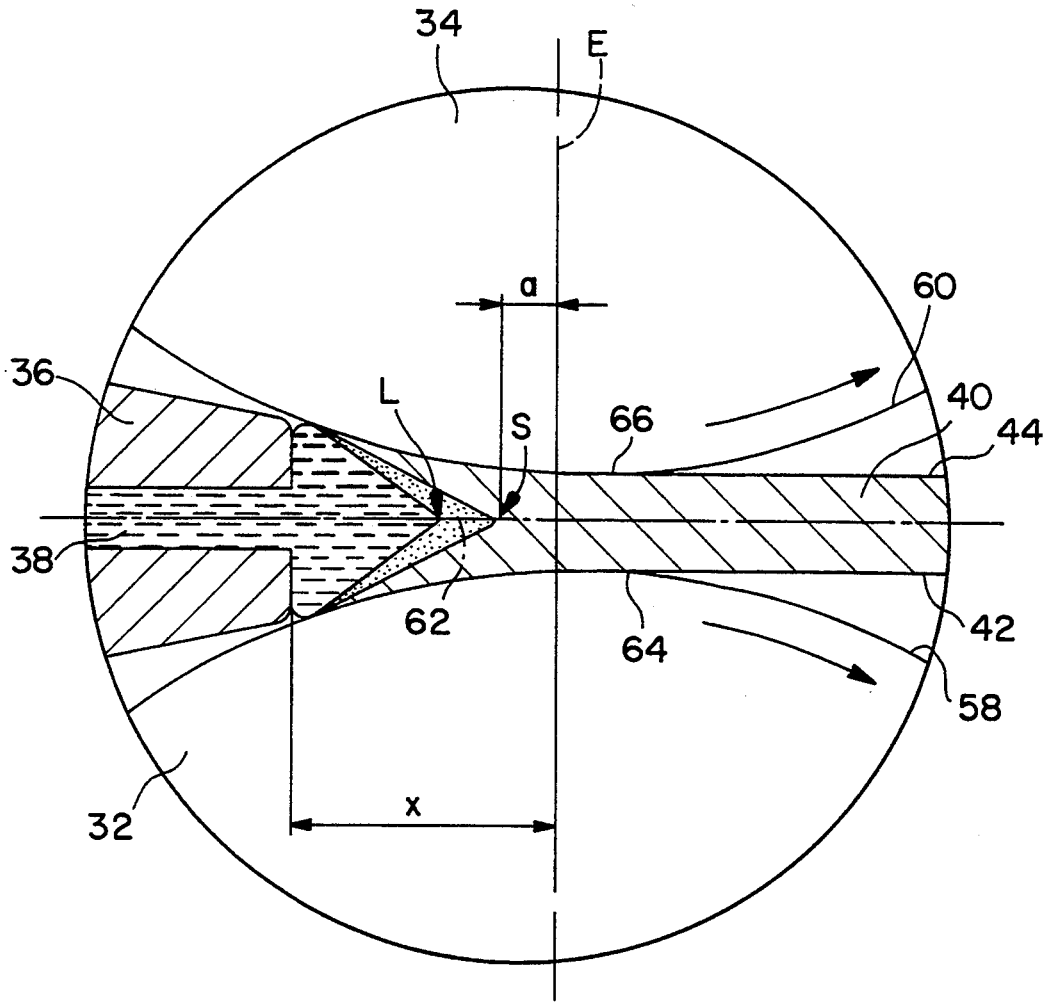
FIG. 2 is an enlarged view of the region of the roll nip.

FIG. 2 shows the hardening region between the casting rolls 32, 34. The orifice of the pouring nozzle 36 is at a distance x from the connecting plane E of the axes $A_u$ and $A_o$ (FIG. 1) of the two casting rolls 32, 34. Liquid aluminium 38 flows out of the pouring nozzle 36 and contacts the surfaces 58, 60 of the two rotating casting rolls 32, 34. The outermost layer of the liquid aluminium 38 immediately begins to harden and is carried along by the rotating casting rolls 32, 34 by means of static friction. At the solidus point S at a distance a from the plane E, all of the metal in the interior of the strip 40 is also hardened. A pasty zone 62, in which the metal is pasty, extends between the solidus point and the liquidus point L.

The solidus point S, and of course also the in this case less interesting liquidus point L, can be displaced with respect to the distance a from the plane E by varying the process parameters.

The pressure of the casting rolls 32, 34 reaches a maximum in the region of the plane E where this forms the roll nip W (FIG. 1). After passing through the plane E, the pressure of the roll surface 58, 60 on the corresponding strip surfaces 42, 44 begins to lessen. The roll surfaces are raised from the strip surfaces in the regions 64, 66.

If sticking begins on the upper or on the lower side, the strip 40 is itself deflected in the corresponding direction with even smaller adhesive force. As soon as the sticking is eliminated, the strip 40 springs back into its original position. This process can also be repeated in the other direction and in an alternating manner. Every time there is even the slightest deflection as a result of the strip 40 sticking to one or other of the casting rolls 32, 34, the strip vibration can be detected by a sensor 57 (FIG. 1) and a corresponding control signal can be emitted.

We claim:

1. Process for the early detection and prevention of sticking when roll casting metals, which comprises: roll casting metal strip in a roll nip of casting rolls to provide a roll cast metal strip with a strip surface; passing the roll cast metal strip from the roll nip to a deflection roller downstream of the roll nip; measuring strip movements in a direction perpendicular to the strip surface between the roll nip and the deflection roller by continuously measuring said movements over small intervals of time; and altering process parameters in a program-controlled manner when strip movements occur.

2. Process according to claim 1 wherein the strip movements are measured between the roll nip and half the distance to the deflector roller.

3. Process according to claim 2 wherein strip movements are measured close the roll nip.

4. Process according to claim 1 wherein strip movements are measured with at least one of the following distributed over the width of the strip: (1) at least one contactless strain transducer on an inductive, capacitive or eddy current basis; (2) at least one optical path measuring device having a laser or an infrared beam; and (3) at least one distance measuring device with ultrasound.

5. Process according to claim 1 wherein the strip movements are measured with at least one of the following: (1) at least one contactless tracer; and (2) at least one supported mechanical tracer.

6. Process according to claim 5 wherein the strip movements are measured with at least one tracing roll.

7. Process according to claim 1 including the step of roll casting metal strip with externally cooled casting rolls with an external cooling system, wherein the strip movements are measured by at least one sensor mounted on at least one cooling hood of the external cooling system.

8. Process according to claim 1 including the step of roll casting metal strip with externally cooled casting rolls and with a retaining frame for the casting rolls, wherein the strip movements are measured by at least one sensor mounted on the retaining frame of the casting rolls.

9. Process according to claim 1 wherein when movements are detected, process parameters are altered in a program-controlled manner after an idle period.

10. Process according to claim 9 wherein the idle period is from 0.5 to 2 seconds.

11. Process according to claim 1 wherein when vibrations are detected, a parting agent is sprayed on the surface of at least one casting roll.

12. Process according to claim 11 wherein the parting agent is sprayed in the direction of rotation of said casting roll and close to the roll nip.

13. Process according to claim 11 wherein the parting agent is a graphite suspension.

14. Process according to claim 1 wherein the roll cast metal strip has a solidus point, and wherein when movement is detected the solidus point is displayed in a downstream direction.

15. Process according to claim 14 wherein the solidus point is displaced by means of a reduced casting speed.

16. Process according to claim 1 wherein the small intervals of time are on the order of 100 milliseconds or less.

* * * * *